United States Patent [19]

Zinkovich

[11] 4,207,880

[45] Jun. 17, 1980

[54] COMBINATION CORRECTIVE TOE SEPARATOR APPARATUS AND PEDICURE AID

[76] Inventor: K. Helen Zinkovich, 6030 N. Sheridan Rd., Chicago, Ill. 60660

[21] Appl. No.: 924,195

[22] Filed: Jul. 13, 1978

[51] Int. Cl.[2] ..... A61F 5/00

[52] U.S. Cl. ..... 128/81 R

[58] Field of Search ..... 128/81 R; 36/11.5

[56] References Cited

U.S. PATENT DOCUMENTS

| | | | |
|---|---|---|---|
| 1,129,670 | 2/1915 | Hardesty | 128/81 R |
| 2,506,308 | 5/1950 | Maynier | 128/81 R |
| 2,595,640 | 5/1952 | Christopoulos | 128/81 R X |
| 2,740,207 | 4/1956 | Starensier | 128/81 R |

FOREIGN PATENT DOCUMENTS

| | | | |
|---|---|---|---|
| 267325 | 3/1927 | United Kingdom | 128/81 R |

*Primary Examiner*—John D. Yasko

*Attorney, Agent, or Firm*—McCaleb, Lucas & Brugman

[57] ABSTRACT

Apparatus utilized as both a corrective aid for separating overlapping or crooked toes, and as a pedicure aid to keep toes separated during pedicures, polish or medicine applications, etc. The apparatus can be worn either interiorly of an appropriate shoe or slipper, or as a separate article of footwear such as a scuff or sandal, and includes a sole portion, padding attached to the underside of the sole portion, and slits formed in the toe region of the sole portion to provide pockets for positive retention of as many toe separator elements as needed.

10 Claims, 6 Drawing Figures

FIG. 1
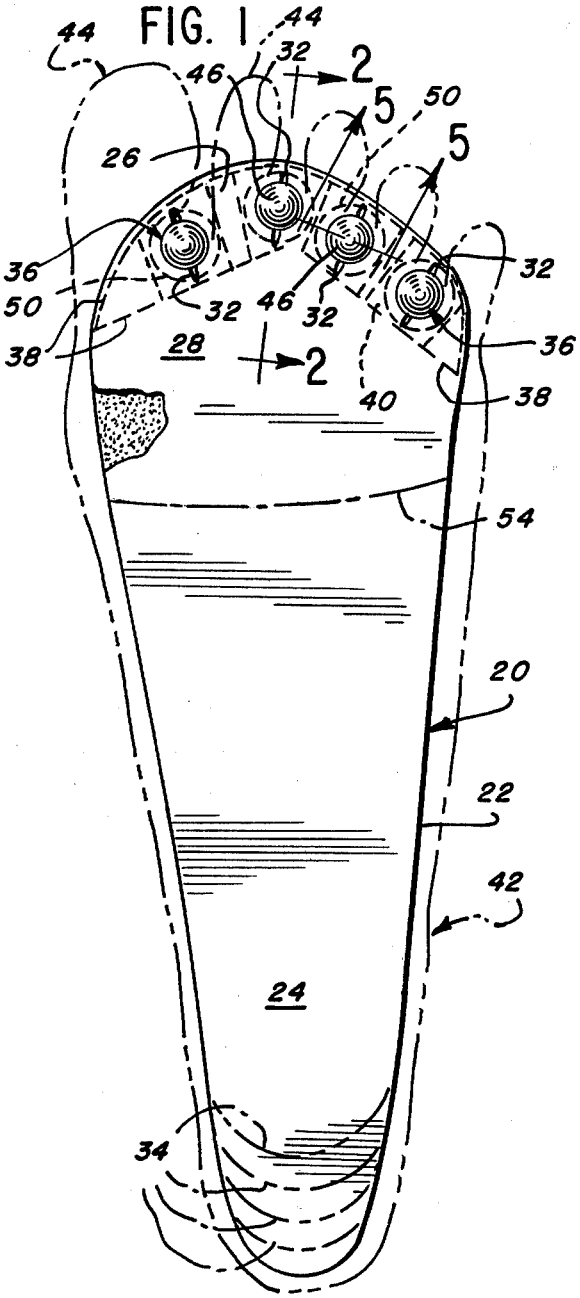
FIG. 2
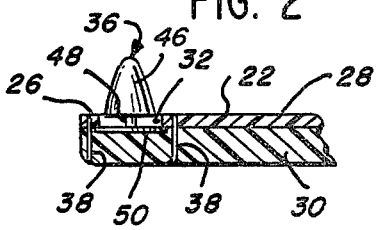
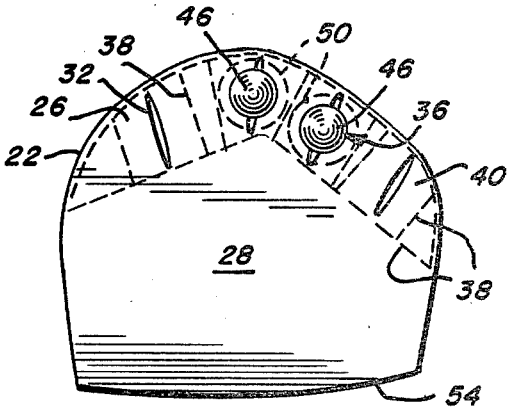
FIG. 3
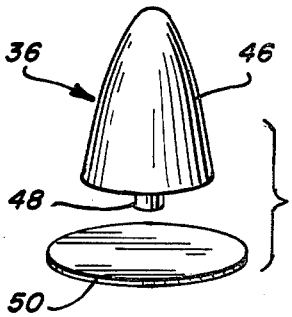
FIG. 4
FIG. 5
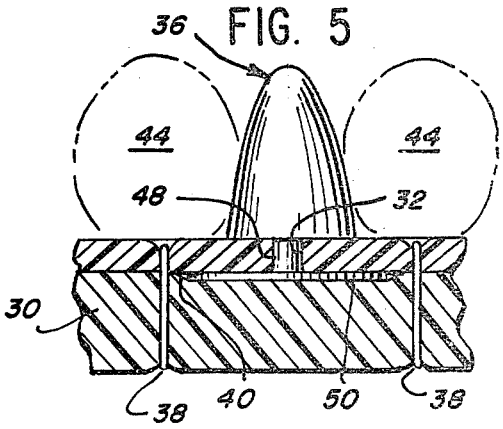
FIG. 6
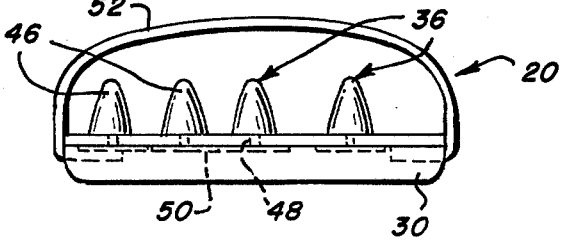

COMBINATION CORRECTIVE TOE SEPARATOR APPARATUS AND PEDICURE AID

BACKGROUND OF THE INVENTION

1. Field of the Invention

This invention relates generally to footwear and more particularly to corrective toe aligning, toe separating, and pedicure aid devices.

2. Description of Prior Art

There have been attempts in the past to provide corrective footwear aids and orthopedic appliances specifically directed to the problems associated with human toes such as separating crooked toes, allowing aeration between diseased or injured toes, or for providing toe separation during various pedicure operations. Most prior art devices are directed toward individual toe separator elements that take any of various forms and utilize various methods of attachment to the desired toe. Other prior art devices are in the form of a strip or connected series of toe separator elements utilized to separate from one to all five toes, being adjustable as desired.

Various methods and structure are utilized to retain such prior art devices to the toes of the foot, including the squeezing of an individual separator element between adjacent toes, utilizing concave surfaces on an individual separator to fit between toes for use inside of shoes, and providing specially configured retainer bars or flanges lying underneath the foot or toe. Another device provides a sandal in which the toe separator elements are attached to a series of thongs leading from an ankle strap to the sole of the device. Still other devices utilize curved tang or sleeve arrangements to slip over individual toes for retention thereto. Yet another device utilizes a series of separator finger elements integrally connected to a plug member mounted on a sole member.

Various disadvantages are found in the above-described prior art devices including the fact that, due to their specific retention arrangements, some prior art devices are too stiff or inflexible and create sore spots on the foot or can not be worn for long continuous periods. Some devices do not have the capability of providing a toe separator apparatus in which as many individual separator elements can be utilized as needed, not provide a device that can be selectively used either inside of a shoe or as a separate scuff.

SUMMARY OF THE INVENTION

The present invention concerns a dual purpose footwear apparatus which can be utilized as a corrective aid to separate crooked or overlapping toes and as a toe separator during pedicures. It can be worn in conjunction with and interiorly of appropriate shoes or slippers or worn separately as a scuff to perform its advantageous functions. The present invention provides padded support to the toes and ball of the foot, as well as an equalizing support to the remainder of the foot so as to prevent cramping and tension points when in use. It allows as many individual toe separators as desired to be selectively utilized, from one to four.

The present toe-separator invention includes a firm yet flexible sole member taking the outline of and extending substantially the length and breadth of the foot and having a padded cushion portion fastened to its underside so as to form pockets and to underlie and cushion the ball of the foot as well as give equalized support. The sole member toe area end portion has cutouts or slits through which the enlarged bases of specially configured toe separator elements are inserted. In effect, a pocket for positively retaining each separator element's base is provided between the slits in the sole member and the underlying padding. The separator elements include a dome-shaped, upper cushion portion that is interconnected to a disc-shaped, firm base portion. As many toe separator elements as desired can be utilized by selectively assembling the bases of the separator elements into the desired slits in the sole member. A lacing or an elastic band or strap can be fastened into, onto or around the sole member to provide a separate scuff or sandal having toe separation capabilities.

In use, the present invention effects toe separation that is wide enough for the intended uses of the device but not so wide as to cause pain. The present invention can effect proper separation and alignment of crooked or overlapping toes during walking, and the separation of toes during pedicures, including nail clipping, nail polish application, during application and drying of medications on infected toe areas. The advantageous uses of the present invention can be accomplished when worn either separately or in conjunction with other appropriate footwear. The invention is constructed of readily washable and durable materials and yet is considered to be inexpensive enough to be disposable after one or a predetermined plurality of uses.

Various prior art problems are overcome by the present invention including that, due to the particular manner of retention of toe separator elements in the sole member as herein disclosed, as many or as few toe separators can be used as desired. Further, the fact that the present device of the present invention is formed of relatively soft and flexible elastomeric materials allows for long periods of continuous use without development of sore spots on the foot.

It is a primary object of the present invention to provide a combination health and corrective aid which both properly aligns crooked toes and separates toes during pedicures.

It is another object of the present invention to provide a sole member for a toe separator footwear device that detachably retains a series of toe separator elements.

It is another object of the present invention to provide a toe separator device in which as many individual toe separator elements can be utilized or selectively detached as desired.

It is a still further object of the present invention to provide a toe separator device which can be worn either inside of appropriate shoes or slippers or as a separate scuff.

It is yet a further object of the present invention to provide a toe separator device formed of flexible and cushioned materials which can be worn for long periods of continuous use without discomfort.

The means by which the foregoing and other objects of the present invention are accomplished and the manner of their accomplishment will be readily understood from the following specification upon reference to the accompanying drawings, in which:

FIG. 1 is a plan view of a fully assembled toe separator device of the present invention and further depicting a wearer's foot in phantom;

FIG. 2 is a cross section view along line 2—2 of FIG. 1 showing various component parts of the toe separator device thereof;

FIG. 3 is a plan view of the modified ball-of-foot and toe portion embodiment of the device of FIG. 1 and depicting the assembly of two toe separator elements;

FIG. 4 is an enlarged, exploded perspective view of the component parts of an individual toe separator element of the present invention;

FIG. 5 is an enlarged cross section view, along line 5—5 of FIG. 1, showing the operation and interconnection of various components of the present invention; and FIG. 6 is an end view of the present invention, modified to be worn separately as a scuff.

DESCRIPTION OF PREFERRED EMBODIMENT

Having reference to the drawings, wherein like reference numerals indicate corresponding elements, there is shown in FIG. 1 an illustration of a toe separator device which is generally depicted by reference numeral 20. The toe separator device 20 comprises a sole member 22, preferably formed as a single piece of relatively firm yet pliable vinyl plastic, which conforms to the outline of the human foot but is of slightly smaller dimension. Sole member 22 has a heel extension portion 24, a toe portion 26, a ball-of-foot area 28, and a padded base 30 which underlies at least portions 26 and 28. The padding 30, preferably formed of sponge or latex foam rubber or a similarly soft cushioning material, is appropriately laminated or otherwise permanently fastened to the underside of at least portions 26 and 28 of sole member 22.

A series of four elongated openings or slits 32 are formed in the toe area 26 of sole member 22 and lie substantially at positions between where a user's toes would fall, and are aligned generally longitudinally to member 22. A series of cut-off lines, denoted generally by reference numeral 34, are provided at the outer end of heel portion 24, the purpose of which will be explained later herein. Four toe separator elements 36 are retained, as will also be explained later, in the slits 32 in sole 22. A pattern of stitching 38 or other type of bonding such as gluing or heat-bonding is performed on toe area 26 to securely bond sole member 22 to padding 30 and to create, in effect, by its strategic placement, a series of pockets 40 (see FIG. 5), one pocket 40 underneath each slit 32.

The outline 42 of the right human foot is depicted in FIG. 1 as it would appear when the toes 44 of the foot are inserted between and extend beyond the separator elements 36.

FIG. 4 depicts an exploded perspective view of a toe separator element 36 which is preferably formed of two separate elements. The first is a dome-shaped upper separator portion 46 having a projection or reduced diameter neck portion 48 extending from the center of its underside and which is preferably cast from a soft latex foam rubber or other relatively soft flexible rubber or vinyl material. The second is a lower disc-shaped retainer member 50 cast from a thin, firmer, less flexible, plastic or vinyl material. Members 46 and 50 are interconnected to form the integral separator element 36 by such forms of bonding as gluing or heat-bonding, for example, the projection 48 to the upper surface of disc 50. Those skilled in the art will readily understand that element 36 can be formed as a unitary member comprising an upper dome interconnected to a disc or button-shaped base if a suitable elastomeric material is used, such as by injection molding or casting techniques, such that the dome portion 46 is supple enough to be comfortable between the toes for long periods of time and yet the disc 50 is firm and rigid enough to be inserted through and retainer within slits 32 and pockets 40, as explained later herein.

A free and detachable band 52 of elastic material can be affixed around the foot and underneath sole member 22 at the instep, or a strap or band 52 of elastic material can be attached permanently, if so desired, by gluing or sewing to the underneath side of sole member 22 (FIG. 6), so that the user's foot can be inserted under strap or band 52 thereby allowing toe separator device 20 to be used as a scuff having toe separating capabilities. In like manner, sole member 22 can be affixed to the foot through use of well-known lacings (not shown), such as in Roman fashion, for example.

Turning now to the operation of toe separator device 20, it is shown in FIG. 3 that two separator elements 36 can be used with the sole 22 to separate, for example, the three middle toes. The appropriate number of separator elements 36 are fastened in an easily detachable fashion to sole 22 by inserting the firm disc 50 of an element 36 through the desired slit 32. In this manner, disc 50 rests and is securely retained in the respective pocket 40 and neck portion 48 is snugly secured by the edges of slit 32. Such additional separator elements 36 as desired can be fastened in sole 22 in like fashion. In this manner, the separator elements 36 are sufficiently rigidly retained in sole 22, yet can be easily detached for changing element 36 from one pocket 40 to another or for cleaning or storage of the device 20.

To use the device 20, the desired separator elements 36 are fastened as above described, and then the toes are inserted into the spaces between the elements 36 (see FIGS. 1 & 5). The user's foot with device 20 thereon can be inserted directly into the user's appropriate shoe or sandal or first into a user's hose or sock. The device 20 can then be worn all day without discomfort to separate the toes. This lack of discomfort is due to the contoured design of the elements 36, the slight movability and not total rigidity afforded by the suppleness and flexibility of the foam rubber or other such materials, the equalizing effect of heel extension 24 on the user's foot, and the use of cushioned and supple materials in the construction of device 20. The sole 22 can, of course, be cut to size to fit the user's foot by cutting sole 22 along the appropriate size lines 34. Both right and left foot shapes of sole 22 are recommended. The separator device 20 can also be used without the user's shoe—such as a scuff around the home for pedicures or to let medicine or polish dry on the toes or nails—by using a lacing, band or strap 52 appropriately affixed around the foot and sole member 22 or permanently attached to sole member 22 (FIG. 6).

It will be understood that slits 32 must be so dimensioned as to readily allow a disc 50 to be inserted therethrough and yet to also tightly grip the projection 48. Further, the pattern of stitching 38 or other types of bonding must be so formed that the respective pockets 40 have just the appropriate amount of room to easily accommodate and yet snugly retain the discs 50 therein. Also the discs 50 are preferably formed as a relatively thin disc so that they do not create uncomfortable bulges within the pockets 40 when in use. The device 20 can be formed without heel extension 24 if desired—by cutting at line 54 (see FIGS. 1 & 3)—such that device 20 only comprises the toe and ball-of-foot portions 26, 28. The dome shape of upper portion 46 of separator elements 36 can, of course, be replaced with several other shapes of toe separators, which are well known in the art.

From the foregoing, it is believed that those skilled in the art will readily appreciate the unique features and advantages of the present invention over previous types of toe separator devices and pedicure aids. Further, it is to be understood that while the present invention has been described in relation to a particular preferred embodiment as set forth in the accompanying drawings and as above described, the same nevertheless is susceptible to change, variation and substitution of equivalents without departure from the spirit and scope of this invention. It is therefore intended that the present invention be unrestricted by the foregoing description and drawings, except as may appear in the following appended claims.

The embodiments of the invention in which an exclusive property or privilege is claimed are defined as follows:

1. A toe separator apparatus comprising a pliable and substantially non-elastic sole member extending substantially the width of the user's foot and having a plurality of slits formed therethrough near the toe end thereof, a plurality of separate elements operable to be selectively and detachably fastened in upstanding fashion in said sole member, said elements characterized as having an upper portion around which a user's toes can be comfortably placed, said upper portions being interconnected by a reduced diameter portion to a disc-shaped lower base portion, said lower base portion being of larger diameter then said reduced diameter portion, whereby said disc portion is operable to be inserted through said slits in said sole member and the reduced diameter portion gripped thereby such that said toe separator element is detachably retained in said sole member.

2. The invention of claim 1, and including padding means so mounted the underside of said sole member as to form pocket means for retaining said disc portions.

3. The invention of claim 1, and wherein said sole member extends substantially the full length of the user's foot.

4. The invention of claim 1, and wherein said upper portion is dome-shaped.

5. A toe separator apparatus comprising a sole member extending substantially the width of the user's foot and having a plurality of slits formed therethrough near the toe end thereof, a plurality of toe separator elements each characterized as having an upper dome-shaped portion around which a user's toes can be comfortably placed, said upper portions being interconnected by a neck portion to a disc-shaped lower base portion, said respective toe separator elements affixed said sole member with the respective said neck portions and disc-shaped portions extending through the respective said slits, a base underlying said sole member in at least the toe end thereof, and bonding means fastening said base member to said sole member at selected positions adjacent said plurality of slits, to thereby form pocket means for retaining said disc portions to said sole member.

6. The invention of claim 5, wherein said base member comprises padding means.

7. A toe separating appliance to be worn under the foot, comprising a sole member extending substantially the width of the foot and from a point underneath the user's toes to a point including at least the ball of the foot; a plurality of elongated openings formed through said sole member in the toe area thereof; a plurality of upstanding toe separator elements, each said element comprising a disc-shaped retainer portion, a dome-shaped upper separator portion about which adjacent toes can be placed for separating the same, and neck means interconnecting said disc retainer and dome separator portions; padding means adjacent the underside of said sole member in at least the toe area thereof; and bonding means for selectively fastening said padding means to said sole member at positions substantially adjacent said elongated openings to provide pocket means; whereby each said separator element is operable to be detachably and positively retained in said sole member by insertion of said disc retainer through a selected said elongated opening into said pocket means.

8. The invention of claim 7, and wherein said bonding means comprises a configured pattern of stitching of said sole member to said padding thereby providing said pocket means.

9. The invention of claim 7, wherein said sole member is formed of a firm but flexible elastomeric material, said disc-shaped retainer portions are formed of a thin, relatively inflexible elastomeric material, and said padding means and said upper separator portions are formed of a relatively soft elastomeric material.

10. The invention of claim 7, including foot fastener means affixed to said sole member to allow said toe separating appliance to be worn as a scuff.

* * * * *